United States Patent [19]

Mouton, Jr.

[11] 4,004,429

[45] Jan. 25, 1977

[54] DEEP UNDERWATER SPHERE

[76] Inventor: William J. Mouton, Jr., 2113 Cleary Ave., Metairie, La. 70001

[22] Filed: May 1, 1974

[21] Appl. No.: 466,045

[52] U.S. Cl. ..... 61/86; 61/.5; 61/92; 52/80

[51] Int. Cl.[2] ..... E02D 29/00

[58] Field of Search ..... 61/46, 46.5, .5; 114/.5 D, .5 T; 52/80, 639, 648, 245, 248, 249, 224

[56] References Cited

UNITED STATES PATENTS

| | | | |
|---|---|---|---|
| 1,249,218 | 12/1917 | Shilling | 52/249 X |
| 1,898,668 | 2/1933 | Jones et al. | 52/690 X |
| 2,292,078 | 8/1942 | Inman et al. | 52/80 X |
| 2,413,243 | 12/1946 | Neff | 52/80 |
| 2,731,334 | 1/1956 | Wissmiller et al. | 52/80 X |
| 3,024,879 | 3/1962 | Kandra | 52/613 |
| 3,075,762 | 1/1963 | Ahrens | 52/80 UX |
| 3,164,111 | 1/1965 | Lanni | 52/80 X |
| 3,247,672 | 4/1966 | Johnson | 61/46.5 X |
| 3,320,969 | 5/1967 | Gordon | 52/80 X |
| 3,417,520 | 12/1968 | Fink | 52/80 |
| 3,686,811 | 8/1972 | Hayes | 61/46.5 UX |
| 3,824,942 | 7/1974 | Stafford et al. | 114/.5 T |

FOREIGN PATENTS OR APPLICATIONS

| | | | |
|---|---|---|---|
| 904,868 | 11/1945 | France | 52/248 |

*Primary Examiner*—Dennis L. Taylor
*Attorney, Agent, or Firm*—Watson, Cole, Grindle & Watson

[57] ABSTRACT

A deep underwater sphere is constructed of a plurality of spherical sections. Each of these sections has a spherical shaped frame made of a plurality of radially arranged trusses with an outer metal shell and an inner metal shell attached to the frame. Adjacent sections are interconnected by connecting selected trusses from each of the sections together. The space between the inner and outer metal shells is filled with a high density mixture which serves to impart resistance to compressional forces placed on the sphere and additionally serves as a ballast for securing the proper specific gravity for sinking of the sphere.

6 Claims, 5 Drawing Figures

DEEP UNDERWATER SPHERE

BACKGROUND OF THE INVENTION

The present invention relates to the provision of an underwater chamber which is capable of being secured in place and is capable of withstanding high compressional forces which are exerted on the chamber by the surrounding environment.

With the recent emphasis placed on obtaining crude oil from the floor of the ocean, research has been pursued for finding a more economical structure to utilize in place of the floating superstructures which are presently mounted extending over the level of the ocean. Attention has recently been directed towards the concept of constructing a concrete pressure vessel for use with sub-sea oil production systems. It has generally been found however, with previously known system that the inability of concrete to carry tension loads can lead to the introduction of surface cracks which in turn enable corrosion, due to migration of the salt water, to occur in the reinforcing steel bars within the composite structure. It has additionally been found that with previously known concrete chambers that it was difficult to reinforce specific places of high stress or point loads within the structure.

The utilization of concrete for providing stability of a superstructure constructed on the open waters has been utilized in various forms, such as illustrated by the U.S. patent to McLean et al, U.S. Pat. No. 2,973,046. In the arrangement illustrated by this patent, a hull filled with concrete is submerged to the floor of the ocean and from this hull a superstructure is constructed extending up out of the water. The utilization of concrete in the structure illustrated by this patent is merely for the purpose of providing sufficient density material for securely mounting the superstructure to the floor of the ocean.

The construction of concrete chambers for underwater use has also been previously attempted, such as illustrated in the U.S. patent to Johnson, U.S. Pat. No. 3,247,672. In the embodiment illustrated by this patent, a concrete chamber is reinforced with steel bars which extend circumferentially through the concrete. Such a chamber however, suffers from the drawbacks noted above especially in that a crack in the concrete will lead to the eventual corrosion of the material.

SUMMARY OF THE PRESENT INVENTION

An object of the present invention is to provide a deep underwater structure which can be submerged within the ocean and utilized for housing a processing station.

A further object of the present invention is to provide a deep underwater spherical structure which is capable of being utilized on the floor of the ocean and withstanding high water pressures.

A further object of the present invention is to provide a deep underwater spherical structure which utilizes steel inner and outer sheels and thereby eliminates the possibility of surface cracks, allows for structurally reinforcing all areas of high stress or point loads and furthermore eliminates tension loads from being exerted on high density material inserted between the inner and outer shells.

In accordance with the present invention, a spherical structure is provided which includes a plurality of spherical sections, each section being constructed of a frame formed by a plurality of interconnected trusses and having a spherical plate attached to both the inner and outer sides of the frame. After the respective sections are interconnected to form the sphere, the space between the inner and outer shells, which is formed by the corresponding inner and outer plates, is filled with a high density material, such as concrete. In this manner, the metal shells provide a structure which is not subjected to the possibility of any cracks within its surface and additionally can be reinforced at various locations, while the concrete which is supplied within the space between the shells helps to provide resistance to the compressional forces placed on the sphere by the surrounding water pressure and additionally serves as a ballast for providing the proper specific gravity for sinking of the sphere within the ocean.

With the utilization of such contruction, it is possible to provide a deep underwater structure, which in addition to avoiding the drawbacks of a concrete structure, also avoids the problems associated with thick-walled pressure vessels. In the utilization of concrete structures which are reinforced with steel rods, in addition to the previously noted drawbacks, an additional problem is the cost involved with the construction of such structures since it is necessary to individually mold each of the concrete structures and accordingly, unless a large number of such structures are produced the cost becomes prohibitive. With the utilization of thick-walled pressure vessels on the other hand, problems arise in welding the adjacent walls together so as to form the overall structure. The structure in accordance with the present invention however, is capable of avoiding the drawbacks of both of these previously known types of structures.

Thus in accordance with the present invention, a plurality of radially extending interconnected trusses are arranged so as to form a spherical triangular frame for each of the sections of the sphere. Metal plates are then attached to both the inner and outer sides of the frame. The adjacent sections are then interconnected by connecting selected trusses of the adjacent sections together. After the overall structure of the inner and outer shells in the frame is formed, the space between the inner and outer shells is filled with concrete. The supply of concrete to this space can be provided with the utilization of a very high strength concrete pumping process.

In the construction of such a spherical structure, plates of three-quarter inch to one inch thickness are utilized for the inner and outer plates and the space between these plates is approximately 30 inches. The utilization of such relatively thin walls avoids the problems normally associated with the welding of thick-walled pressure vessels. The rigidity and strength of the structure however is maintained since the thin walls are backed up by the trusses, which generally consist of heavy angle irons, and the concrete. Furthermore, since the spherical structure is divided into a plurality of identical spherical triangles, generally 32 in number, it is relatively easy to reinforce specific areas for point loads and around openings which are provided within this sphere.

BRIEF DESCRIPTIONS OF THE DRAWINGS

FIG. 1 provides a perspective view of a spherical structure formed in accordance with the present invention.

DETAILED DESCRIPTION OF THE PREFERRED EMBODIMENTS

Figure 1:
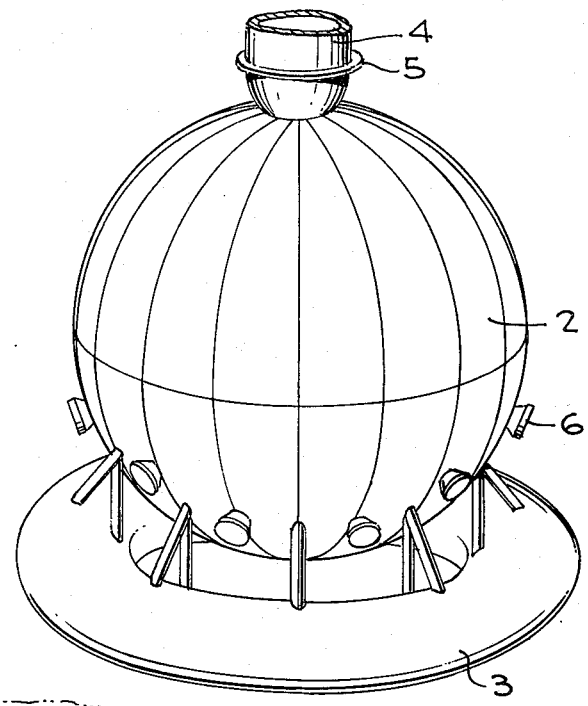

As illustrated in FIG. 1, a spherical structure 1 for deep underwater use is constructed from a plurality of separately formed spherical sections 2 which are interconnected for forming the spherical structure. In the illustrated embodiment, there are 32 such spherical sections, each of which is substantially identical with the other sections. Since the sections are substantially identical even in the formation of a single sphere it is possible to effectively mass produce the sections since there are 32 such sections.

Figure 2:
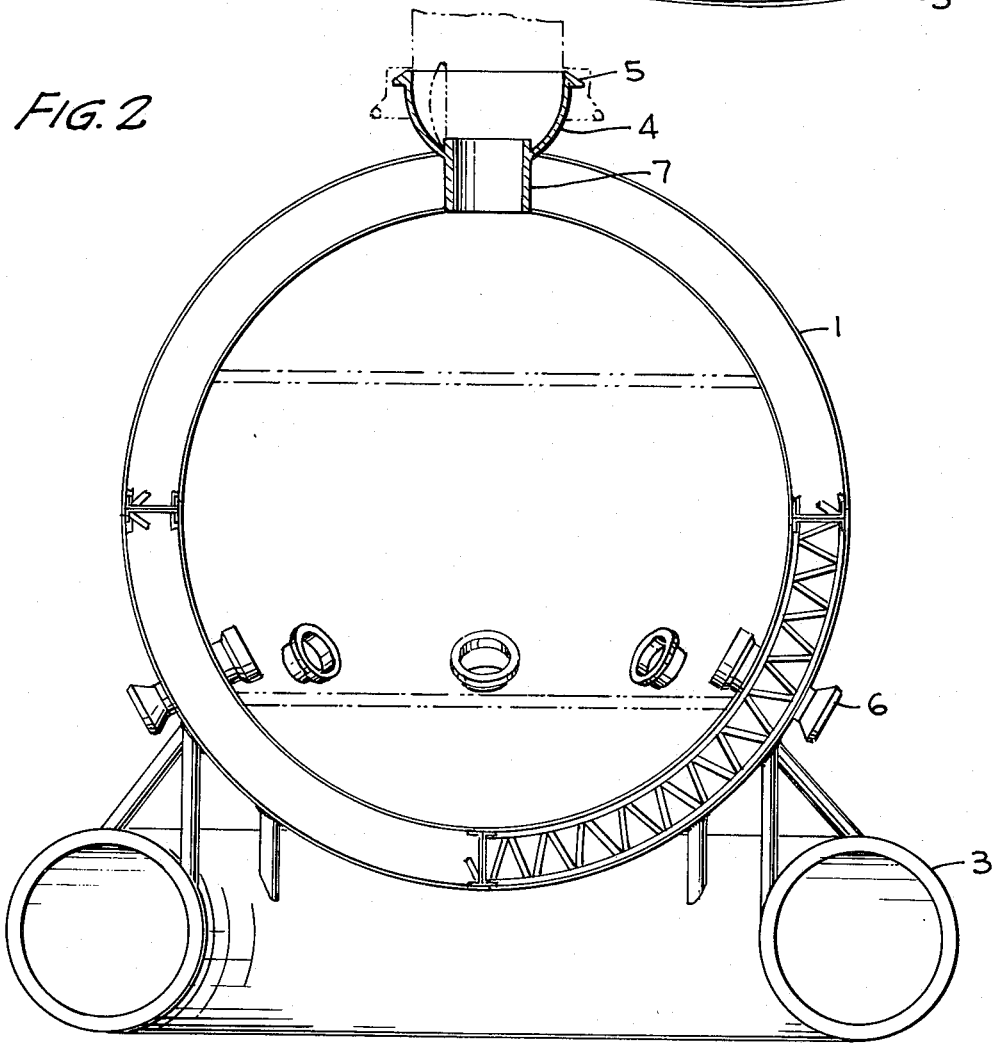
FIG. 2 is a sectional view of the spherical structure illustrated in FIG. 1.
Figure 3:
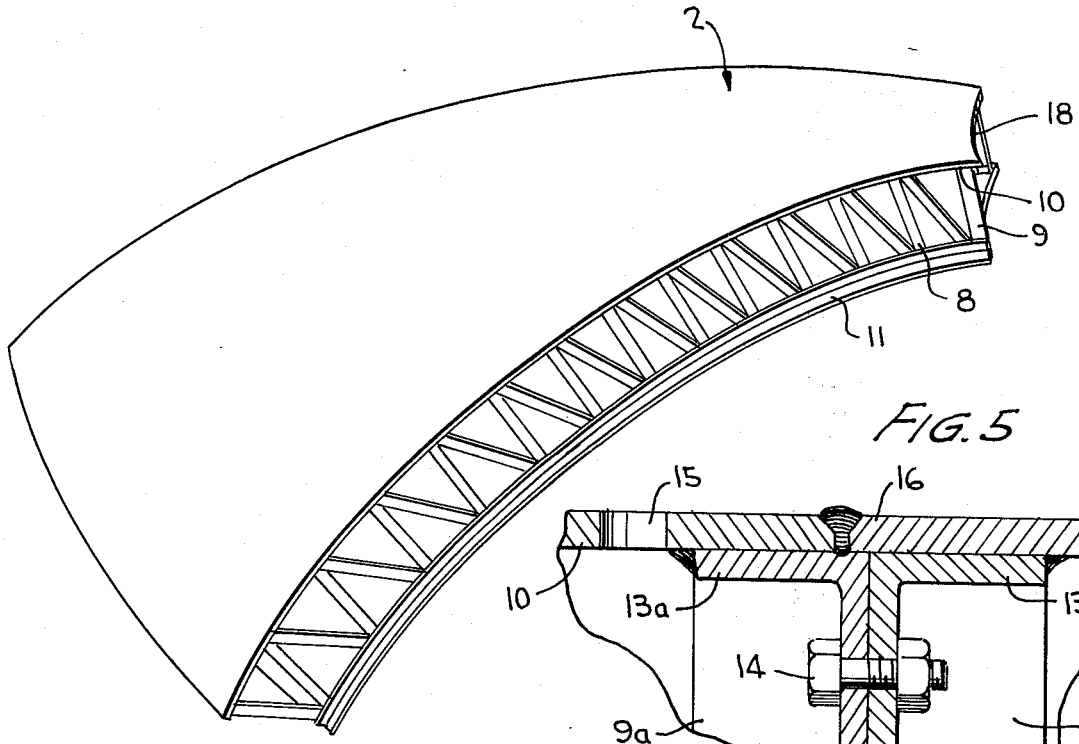
FIG. 3 is a perspective view of one spherical section of the spherical structure illustrated in FIG. 1.

In utilizing such a spherical structure on the bottom of the ocean floor, in order to provide positive buoyancy a donut structure 3 is provided, which may simply be a ring of compartmented barrels that are filled so as to provide negative buoyancy and also can be emptied to provide positive buoyancy for complete stable vertical movement of the unit. The spherical structure is mounted on the donut by the utlization of a plurality of structural bars such as shown in FIGS. 1 and 2.

Since the structure can be utilized for housing processing equipment for crude oil which is extracted from the floor of the ocean, a plurality of inlet and outlet ports 6 are provided for coupling with various outside equipment. One example of the type of processing equipment that can be provided within such a spherical structure is a separator system for separating oil, gas and water. By providing such processing equipment within such a spherical structure it is possible to eliminate the need for a floating superstructure above the ocean floor.

In order to enable entry into the spherical structure 1, the opening 7 is provided within the top of the structure. This opening is connected to a flange element 4 which has a sealing ring 5 at its upper end. This opening 7 within the sphere enables workmen to descend from sea level and enter the sphere for the operation and maintainence of the processing equipment maintained within the sphere. Accordingly for this purpose, an extension chamber would be coupled to the flange 4 such as illustrated by the dashed-lines in FIG. 2. The basic transportation device for enabling workers to get down to such a sphere with no more than "one atmosphere" of pressure has already been previously developed by Shell Oil Company and such a procedure could be utilized in the utilization of the spherical structure described.

Each of the spherical sections is formed with the utilization of a substantially triangular spherical shaped frame. The frame is made of a plurality of interconnected trusses formed of a plurality of web members 8, with the trusses being arranged so as to extend in a substantially radial direction from the center of the sphere. The web members 8 are interconnected so as to form each truss or side of the frame with end web members 9 being provided at each corner. For those sections which are utilized at the top of the sphere, the frame is additionally provided with a polar sectional frame portion or truss 18. When the spherical sections are interconnected, the polar frame portions 18 form the opening 7 in the top of the sphere. An outer metal plate 10 is connected to the triangular spherical frame and likewise an inner metal plate 11 is connected to the inside surface of the frame. These inner and outer plates are utilized for forming the inner and outer shells of the spherical structure. The metal plates can be generally made up of a steel material, with the outer plates being approximately one inch in thickness and the inner plate three quarters of an inch in thickness. The spacing which is provided between the respective inner and outer plates by the trusses is generally approximately 30 inches.

After each of the frames is produced the inner and outer plates are attached and subsequently 16 such sections are interconnected for forming each half of the sphere. In this manner the bottom half of the sphere is formed so as to effectively form a large cup or hemisphere, which, for example, is 36 feet in diameter and 18 feet high, with the interior diameter of the sphere accordingly being 31 feet. Subsequently, the other 16 sections are constructed in the form of a dome so as to complete the entire sphere.

Figure 5:
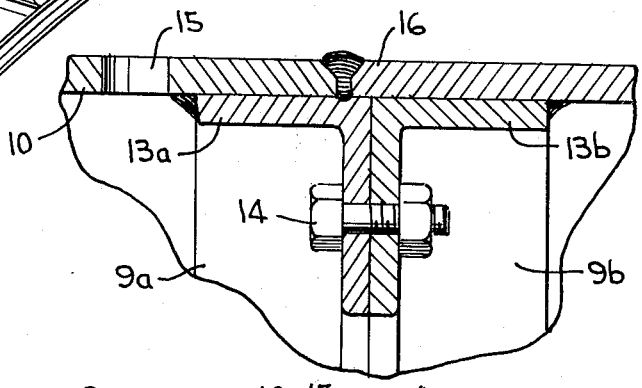
FIG. 5 is an enlarged view of section A in FIG. 4.
Figure 4:
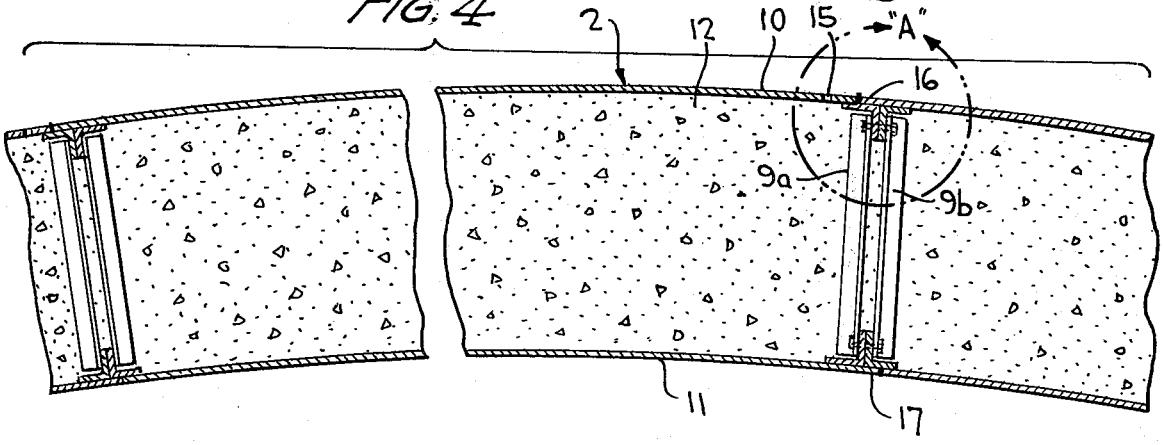
FIG. 4 is a cross sectional view through a portion of the spherical structure illustrating the interconnection between adjacent spherical sections.

Each of the end trusses 9 has welded to its ends angular chord members 13. The spherical sections can then be interconnected by connecting selected web members, i.e. the end web members, together by bolting together the upper and lower chord members. Thus as shown in FIGS. 4 and 5, end web members 9*a* and 9*b* are coupled together by passing a bolt 14 through the chord members 13*a* and 13*b*. These chord members can also be welded together so as to secure the connection. The outer plate 10 and the inner plate 11 of each of the sections 2 extend past the end of the truss of the frame at either one or the other end. These extended portions can be at opposite ends such as shown in FIG. 4. The extended portions are then overlapped with the chord member of the adjacent truss and are welded to the chord member so as to be welded to the frame. The edge of the overlapped plate is also welded to the plate of the adjacent section. In this welding process, the chord member serves as an effective backstop for the weld. Accordingly, in this manner the spherical structure is erected.

After the spherical sections are interconnected and arranged into the spherical structure, the space between the inner and outer shells formed by plates 11 and 10, is filled with a high density mixture, generally concrete. When forming the spherical structure, openings 15 are left within the outer shell. The concrete mixture, which, for example, is of 10,000 psi strength, is supplied through these openings 15 with the utilization of a concrete pumping filling process. Subsequent to the filling of the space between the inner and outer shells, steel plug inserts are inserted within the openings 15 and are welded in place so as to close the openings. Upon filling of the spaces within the spherical structure with concrete and the closing of the openings 15, the spherical structure is completed and ready for use. Such a structure is capable of being utilized at a depth of 1500 feet with an internal stress thus on the order of 2600 psi to 3300 psi, allowing a factor of safety of 3 for 10,000 psi concrete.

Prior to filling the interior area between the plates with concrete it is possible to provide a plurality of internal reinforcing bars or strands such as are commonly utilized for reinforcing concrete structures. It is also possible to provide a pluraltiy of pre-stressing strands, which are post-tensioned, in this internal area. These strands are generally encased in plastic tubes and are anchored in a conventional post-tensioning manner. If such reinforcing bars and pre-stressing strands are provided, they would be provided so as to extend in a circumferential direction around the sphere.

It is noted that the above description and the accompanying drawings are provided merely to present an exemplary embodiment of the present invention and that additional modifications of such embodiment are possible within the scope of this invention without deviating from the spirit thereof.

I claim:

1. A deep underwater sphere comprising: a plurality of spherical sections; each said section having a spherical shaped frame made of a plurality of radially arranged trusses, an outer metal place and an inner metal plate, said inner and outer metal plates are both made of spherical shaped plates; selected said trusses from each of said sections being connected to selected said trusses of an adjacent said section; said plates being arranged on a respective one of said trusses frames such that both said inner and outer plates each extend over said respective frame at one end and such extended portion overlaps said trusses of said adjacent section and are welded to said adjacent section; and a concrete mixture filling the space between said inner and outer plates for serving to impart resistance to compressional forces placed on the sphere and serving as a ballast for securing the proper specific gravity for sinking of the sphere.

2. An arrangement as defined in claim 1 wherein each said frame is substantially triangular shaped and said sections are substantially identical to one another.

3. An arrangement as defined in claim 1 wherein said selected trusses are connected by being bolted together.

4. An arrangement as defined in claim 1 wherein said outer plate is a spherical shaped plate member of 1 inch thickness, said inner plate is a spherical shaped plate member of ¾ inch thickness and the spacing between said inner and outer plates is 30 inches.

5. An arrangement as defined in claim 1 wherein said sections utilized for forming the upper half of the sphere each have a polar shaped frame portion at their vertex side and said polar shaped frame portions are interconnected for forming a substantially circular opening in the upper end of the sphere.

6. An arrangement as defined in claim 5 further comprising at least one inlet port and at least one outlet port.

* * * * *